United States Patent [19]

Koichi

[11] Patent Number: 4,551,005

[45] Date of Patent: Nov. 5, 1985

[54] METHOD OF FORMING IMAGES OF SENSOR PATTERNS IN EFFECTING IMAGE DENSITY CONTROL OF ELECTROPHOTOGRAPHIC COPYING APPARATUS

[75] Inventor: Yasushi Koichi, Yamato, Japan

[73] Assignee: Ricoh Company Ltd., Japan

[21] Appl. No.: 485,015

[22] Filed: Apr. 14, 1983

[30] Foreign Application Priority Data

| | | | |
|---|---|---|---|
| Apr. 16, 1982 | [JP] | Japan | 57-62592 |
| Apr. 20, 1982 | [JP] | Japan | 57-64639 |
| Jun. 24, 1982 | [JP] | Japan | 57-107525 |
| Jun. 28, 1982 | [JP] | Japan | 57-109820 |

[51] Int. Cl.[4] ..... G03G 15/00

[52] U.S. Cl. ..... 355/8; 355/3 DD; 355/14 D; 355/14 E; 355/55

[58] Field of Search ..... 355/3 R, 15, 3 DD, 14 D, 355/14 R, 8, 55, 56

[56] References Cited

U.S. PATENT DOCUMENTS

| | | | |
|---|---|---|---|
| 3,649,262 | 3/1972 | Cade et al. | 355/15 X |
| 4,017,170 | 4/1977 | Komori et al. | 355/3 R |
| 4,313,671 | 2/1982 | Kuru | 355/3 DD X |

*Primary Examiner*—A. C. Prescott

*Attorney, Agent, or Firm*—Guy W. Shoup

[57] ABSTRACT

Forming a visible image of a sensor pattern on a photosensitive member for use in controlling image density of copies, wherein the sensor pattern of a reference density is placed substantially flush with a surface on which a document to be copied is placed; the surface of the photosensitive member is exposed to an optical image of the sensor pattern to form a latent image of the sensor pattern in a region of the photosensitive member outside a document image forming region; and the latent image is developed to obtain a visible image of the sensor pattern. The density sensed by a sensor element produces an electric signal used for controlling the density of an image. The region of the latent image of the sensor pattern is restricted to within a region of the surface of the photosensitive member on which an image of the sensor pattern would be formed when copying is performed at a minimum rate of reduction, by means of erasing an electric charge from the surface of the photosensitive member excepting the document image forming region and the region of the latent image of the sensor pattern by irradiation performed between the step of electrically charging and the step of developing. By this feature, it is possible to obtain pattern images of the same size both in an equal image size copying mode and an unequal image size copying mode to thereby eliminate errors that might otherwise be committed by the sensor element.

4 Claims, 8 Drawing Figures

METHOD OF FORMING IMAGES OF SENSOR PATTERNS IN EFFECTING IMAGE DENSITY CONTROL OF ELECTROPHOTOGRAPHIC COPYING APPARATUS

BACKGROUND OF THE INVENTION

This invention relates to a method of forming images of sensor patterns on a photosensitive member for effecting image density control in an electrophotographic copying apparatus.

In one method known in the art of controlling the density of an image of a copy of a document produced by means of an electrophotographic copying apparatus to obtain the desired degree of density for the reproduced image, a sensor pattern of a reference density is provided substantially flush with the document support surface and irradiated from a document image exposing light source to expose a photosensitive member to an optical image of the sensor pattern by means of an exposing optical system to form thereon a latent image of the pattern which is developed into a visible image of the pattern by means of an image developing device. The visible image of the pattern thus obtained is sensed by means of photoelectric element to produce an electric output which is used for effecting control of the toner density of the developing agent, the amounts of exposure and the values of developing bias, and charging conditions that influence the density of the visible image, to thereby effect control of image density. This method is generally referred to as a P-sensor method and the photoelectric sensor used in this method is referred to as a P-sensor element while the sensor pattern is referred to as a P-sensor pattern.

The value of an output of the P-sensor element is inputted to a control circuit where it is compared with a value set beforehand for a standard image density. When they differ from each other, the toner density, the amount of exposing, the value of the developing bias, or charging conditions are revised in accordance with the difference between the output of the P-sensor element and the standard image density, so that control is effected in a manner to allow copies of the standard image density to be obtained in a stable manner when the document to be copied has the standard image density.

When there is a difference between the density of the document and the standard image density or when a document of the standard image density is used to produce copies of images of higher or lower density than the standard image density, the value of a density set for controlling the image density compared with an actual output of the P-sensor element may be varied to thereby vary the conditions of charging, exposing and developing, thereby enabling copies of the desired image density to be obtained.

Images of patterns formed on the photosensitive member that are used in this control method are obtained by the same means and following the same process as those used for forming images of a document on the photosensitive member. Thus the method is suitable for use as a method for controlling image density. However, unless a sensor pattern is mounted in a right place and has a high dimensional accuracy, variations would occur in the position of an image of a toner pattern formed on the photosensitive member and its dimensions would deviate from the actual dimensions of the sensor pattern. When copying is performed in an unequal image size copying mode, an image of the toner pattern would also be formed in the unequal image size copying mode so that it would be reduced or enlarged as the case may be. When this is the case, an error would be produced and an unnecessary load would be applied to the cleaning device, if sensing of the density of the image of the toner pattern is performed by means of a photoelectric element located in a predetermined position.

In effecting pattern image formation in the prior art, it has hitherto been customary to scan a sensor pattern by means of a scanner (scanning and exposing member) at the same scanning velocity as a scanning velocity at which scanning of the document image regions would be performed. The photosensitive member has hitherto been moved at a predetermined velocity to effect exposing of the photosensitive member to an optical image of the sensor pattern under the same conditions as the conditions under which exposing of the photosensitive member to a document image would be performed. When pattern formation is carried out as described hereinabove, it is necessary to bring the scanner to a halt with a high degree of accuracy in a predetermined position, making it necessary to effect assembling of parts and adjustments thereof with great care. To move the sensor pattern at a predetermined velocity would require the use of a section for preliminarily moving it at a lower velocity before it achieves the predetermined velocity, and the distance to be covered by the scanner in its movement would have to be greater than the required distance for effecting scanning. This would increase the size of the copying apparatus.

SUMMARY OF THE INVENTION

This invention has been developed for the purpose of obviating the aforesaid disadvantages of the prior art. Accordingly one object of the invention is to provide a method of forming images of a sensor pattern for effecting image density control which is capable of providing a toner image of the sensor pattern on the surface of a photosensitive member that shows no variations in position, shape and dimension, irrespective of whether operation is performed in a fixed image size copying mode or a variable image size copying mode.

Another object is to provide a method of forming images of a sensor pattern for effecting image density control which is capable of forming on a photosensitive member an image of the sensor pattern of a size suiting sensing by a P-sensor element without being affected by the accuracy of the position in which the scanning and exposing mechanism of the optical system if brought to a halt and the zone in which scanning is carried out, irrespective of whether operation is performed in equal image size copying mode or unequal image size copying mode.

The aforesaid first object is accomplished according to the invention by removing, in the method of forming images of a sensor pattern for effecting image density control described hereinabove, an electric charge from the surface of the photosensitive member excepting a document image forming region and a sensor pattern image forming region of predetermined position and shape on the photosensitive member electrically charged on its entire surface in a charging step by irradiation with light beams other than the image exposing light prior to developing effected in a developing step, and forming an image of the sensor pattern by the image exposing means at least in the sensor pattern image forming region to thereby form a visible image of the sensor pattern of the predetermined shape in the predetermined position on the photosensitive member.

The aforesaid second object is accomplished according to the invention by stopping, in the method of forming images of a sensor pattern for effecting image density control described hereinabove, the scanning operation of the scanner when the photosensitive member is exposed to an optical image of the sensor pattern and moving the photosensitive member at a predetermined velocity to thereby form an image of the sensor pattern on the photosensitive member.

DETAILED DESCRIPTION OF THE PREFERRED EMBODIMENTS

The invention will now be described by referring to the accompanying drawing showing its embodiments.

Figure 1:
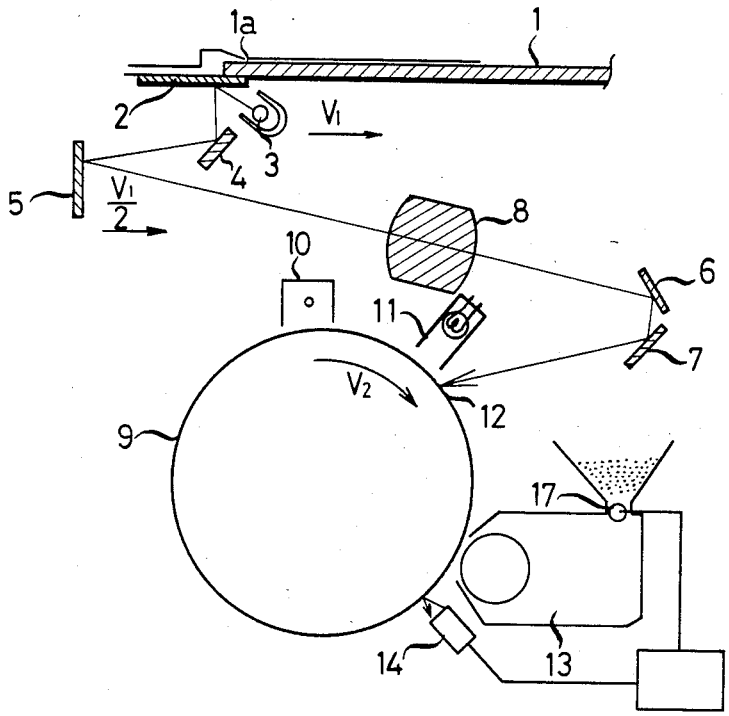
FIG. 1 is a sectional view of the essential portions of one example of the electrophotographic copying apparatus suitable for effecting pattern image formation by the method according to the invention.

FIG. 1 shows one example of the electrophotographic copying apparatus with special reference to its exposing device and parts in the vicinity of the photosensitive member suitable for carrying one embodiment of the sensor pattern image forming method according to the invention into practice.

A contact glass member 1 adapted to have a document to be copied placed thereon has mounted on its bottom surface adjacent an image forward end position 1*a* as viewed in a vertical direction a sensor pattern 2 having a reference density. Located below the contact glass member 1 are a light source 3, mirrors 4, 5, 6 and 7 and a lens 8 constituting scanning and exposing optical system known in the art having a scanning zone including the sensor pattern 2. A photosensitive drum 9 adapted to rotate in a direction indicated by an arrow has mounted around it in the direction of the arrow a charger 10, an eraser 11 for partially removing the electric charge, an image exposing position 12 in which the photosensitive drum 9 is exposed to an optical image by the scanning and exposing optical system, a developing device 13, and a P-sensor element 14. Other parts of the copying apparatus are eliminated because they have no relevance to the present invention. The eraser 11 comprises a light source located in a casing for removing the electric charge from the surface of the photosensitive drum 9 by irradiation with light beams.

Scanning and exposing are performed by moving the light source 3 and first mirror 4 at a velocity $V_1$ and the second mirror 5 at a velocity $V_1/2$ in synchronism with each other in the same direction and by rotating the photosensitive drum 9 at a peripheral velocity $V_2$. In an equal image size copying mode, $V_1=V_2$, and in an unequal image size copying mode, the lens 8 and third and fourth mirrors 6 and 7 are displaced in accordance with magnification m to perform scanning at $V_1=V_2/m$.

The photosensitive drum 9 having its entire surface charged by the charger 10 has the electric charge removed from its surface excepting a document image forming region and a predetermined image forming region of the sensor pattern for controlling the image density by irradiation with light beams by the eraser 11. At this time, erasing light beams used to determine the image forming region of the sensor pattern may be shared by other erasers, such as the ones for erasing the electric charge at the front and rear ends of the image and the electric charge on the side of the image.

After the photosensitive drum 9 has had its entire surface electrically charged by the charger 10 and has had the electric charge removed from its surface excepting the document image forming region and the sensor pattern image forming region, the photosensitive drum 9 is exposed at the exposing position 12 to an optical image of the sensor pattern 2 by the scanning and exposing optical system. The region of the photosensitive drum 9 outside the predetermined sensor pattern image forming regions has had the electric charge already removed as aforesaid, so that by forming an image of the sensor pattern 2 on the photosensitive drum 9 in dimensions substantially greater than the predetermined dimension thereof, it is possible to cause the electric charge to remain in an amount commensurate with the density of the sensor pattern 2 only in a predetermined sensor pattern toner image forming region still remaining charged, even if the image of the pattern is enlarged or reduced in an unequal image size copying mode.

The eraser 11 may be located between the exposing position 12 and the developing device 13. In this case, the region of the image of the sensor pattern 2 has the electric charge reduced by exposing of the photosensitive drum 9 and then the electric charge is completely removed from the region outside the predetermined sensor pattern forming region by irradiation with light beams from the eraser 11.

A concrete example will be described. Assume that the dimensions of the sensor pattern 2 are 20 mm in an axial direction of the photosensitive drum 9 and 28 mm in a scanning direction. With the sensor pattern 2 located below the contact glass member 1, it has an original density (OD) of 0.8 to bring the volume of light thereon to a level equal to the volume of light on the glass member 1. The sensor pattern 2 is mounted in a position in the center of the optical axis.

Figure 2:
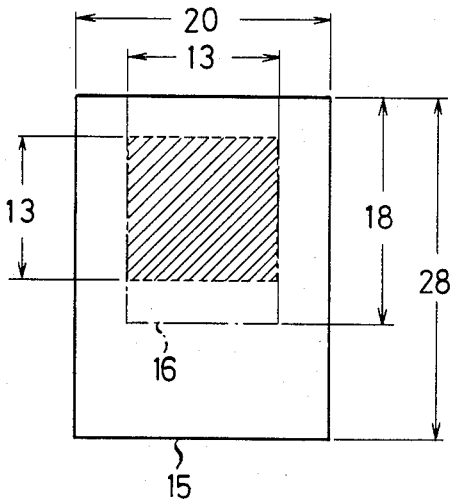
FIG. 2 is a schematic view in explanation of the pattern image forming process in equal image size copying mode and an unequal image size copying mode.

Assume that copying is carried out to produce copies of a size 0.65 time the original size. In this context, an original refers to a document to be copied. In this case, the lens 8 and mirrors 6 and 7 would be shifted rightwardly in FIG. 1, and scanning would be performed by changing the scanning velocity of the scanner to 1/0.65 the scanning velocity at which scanning would be effected in a copying mode for producing copies of the same size as the original. As a result, an image of the sensor pattern 2 projected on to the surface of the photosensitive drum 9 would have its lengths in the scanning direction and in the direction normal to the scanning direction reduced to 0.65 time as great as its original lengths, so that, as shown in FIG. 2, the image would have dimensions of 20×28 mm as shown by a solid line 15 when the copy is of the same size as the original and it would have dimensions of 13×18 mm as indicated by a dash-and-dot line 16 when the copy has its size reduced below that of the original. If the image is developed, the toner pattern obtained would show variations and cause an error to be made in sensing.

If the size of an image formed in a reduced image size copying mode were made to have a predetermined value, an image formed in a mode of obtaining copies of the same size as the original would become larger than the actual size, thereby applying an excess load to a cleaning unit. When copying is performed in an increased image size copying mode, the dimensions of the sensor pattern images would become still greater.

The aforesaid disadvantage is eliminated by the method according to the invention, in which a hatched region (13×13 mm) shown in FIG. 2 is set as a predetermined image forming region of the sensor pattern and region outside the hatched region has the electric charge removed by irradiation with light beams from the eraser 11. This gives an image of the toner pattern of a size 13×13 mmm both in an equal image size and unequal image size copying modes, so that an error committed in sensing due to the size of the image of the sensor pattern is eliminated and the load applied to the cleaning unit is reduced. Partial removal of the electric charge by means of the eraser 11 determined the region of the sensor pattern image. Thus by maintaining the precision of operation of the eraser 11 at a high level, the need to increase the precision and accuracy with which other parts are mounted is eliminated. Erasion can be performed with a high degree of accuracy by effectively controlling the timing with which irradiation of light beams is performed (control of accuracy of turning on and off the light beams). By effecting control in this fashion, it is possible to form images of the sensor pattern of the same shape in the same position at all times. Particularly when multiple image size copying is performed only by changing the position of the optical system while driving the photosensitive drum at the same velocity, it is possible to effect control of the timing with which light beams from the eraser 11 are turned on and off with the same program at all times, thereby facilitating control.

FIG. 1 shows an example of effecting control of image density by actuating a toner supply roller 17 based on the result obtained by sensing the density of the image of the sensor pattern by the P sensor element 14 to send an additional supply of toner to the developing device 13. Needless to say, any one or two factors governing the image density selected from the group of factors consisting of the values of the developing bias, conditions of charging the photosensitive drum and luminosity of the exposing light source.

Figure 3:
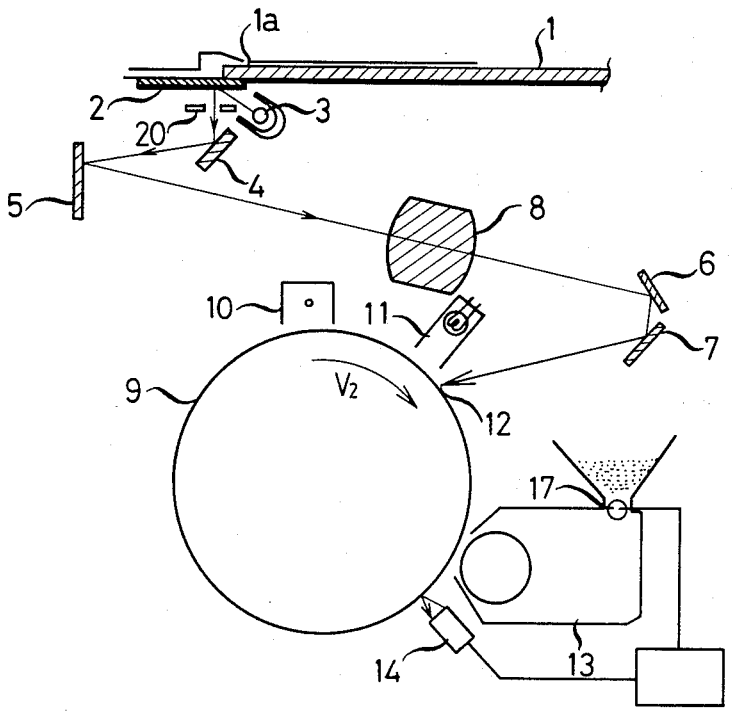
FIG. 3 is a sectional view of another example of the electrophotographic copying apparatus suitable for carrying the pattern image forming method according to the invention into practice.

Another embodiment of the invention will be described by referring to FIG. 3. The copying apparatus suitable for carrying the second embodiment of the invention into practice is similar to that suitable for carrying the first embodiment of the invention shown in FIG. 1 except for parts described hereinbelow. In FIG. 3, parts similar to those shown in FIG. 1 are designated by like reference characters.

A slit 20 is inserted in an optical path leading from the P-sensor pattern 2 to the first mirror 4. In a sensor pattern exposing step in which the photosensitive drum 9 is exposed to an optical image of the P-sensor pattern 2, the photosensitive drum 9 is rotated at the predetermined peripheral velocity $V_2$ and the light source 3 and mirrors 4 and 5 remain stationary.

Exposing of the photosensitive drum 9 to an optical image of a document or original is carried out as usual, and the electric charge is removed by means of the eraser 11 from a region outside a document image forming region and a predetermined sensor pattern forming region on the photosensitive drum 9, in the same manner as described by referring to the first embodiment of the invention shown in FIG. 1.

Forming of a sensor pattern image by the method according to the invention will be described in detail by referring to numerical values.

The sensor pattern 2 had a length of 24 mm in the scanning direction, and the slit 20 has an opening of a width of 6 mm. The sensing and exposing optical system had its home position set 15 mm away from the forward end of a document, to thereby keep constant the velocity at which scanning of the document is carried out. The home position had an allowable error of ±6 mm.

To avoid any influences which forming of the P-sensor pattern image might have on other units, control was effected such that sensor pattern image forming was performed once while scanning was performed five times. When scanning was performed at times other than those at which forming of the image pattern was performed, an electric charge in a region of the photosensitive drum 9 other than a document image forming region was removed by means of the eraser 11 and the length of time during which the scanner was brought to a halt was reduced, to improve copying efficiency. A P-sensor control section was constructed such that it was actuated only in a run in which a P-sensor pattern image was formed, or in synchronism with the timing with which on-off control of the eraser 11 was effected.

When a P-sensor pattern image was formed, the photosensitive drum 9 was rotated and units necessary for following a copying process were actuated as a print button was depressed. However, the scanner remained inoperative. An electric charge was removed by means of the eraser 11 under program control to be turned on and off by a pattern image forming section in synchronism with the rotation of the photosensitive drum 9 from a region other than the document image forming region on the photosensitive drum 9 electrically charged by means of the charger by leaving a predetermined sensor pattern image forming region which remained charged.

When an optical image of the sensor pattern 2 was projected on to the photosensitive drum 9 to expose the latter thereto, an electrostatic latent image was formed only in the region in which the charge remained unremoved and developed into a toner image which had its density sensed by the P-sensor element 14. When the density sensed by the P-sensor element 14 was distinct from the density set as a reference density, the toner supply roller 17 was actuated to send an additional supply of toner to the developing device 13.

When the sensor pattern image was formed as described above, the scanner remained inoperative for 0.9 second after the light source or exposing lamp 3 was turned on (for 0.3 second when no sensor pattern image was formed). When this as the case, the pattern 2 was exposed in a circumferential direction for a length of 23 mm in an equal image size copying mode without actuation of the eraser 11. By cutting the circumferential length of the pattern by means of the eraser 11, the length of the P-sensor image pattern as measured circumferentially of the drum 9 was reduced to 14 mm. As a result, the trouble of applying an unnecessarily large load to the cleaning unit was eliminated.

When copying was carried out by increasing the size of the original, an optical image of the sensor pattern 2 projected on to the photosensitive drum 9 became greater than that projected when copying was effected in the same size as the original and became smaller than that projected when copying was effected in a size smaller than that of the original. However, by cutting the length by means of the eraser 11 to the same value, it was possible to obtain toner pattern images of the same size at all times, irrespective of the size of the copies produced.

From the foregoing description, it will be appreciated that the second embodiment of the invention shown in FIG. 3 makes it possible, in addition to the effects achieved by the first embodiment shown in FIG. 1, to eliminate the need to increase the distance covered by the movement of the scanning and exposing optical system for forming a sensor pattern image which has been made necessary in the prior art to help the scanner achieve a predetermined velocity of movement. This enables an overall compact size to be obtained in a copying apparatus. Moreover, the need to bring the scanning and exposing optical system to a halt accurately in a predetermined position is eliminated, thereby facilitating adjustments of assembled parts and reducing cost.

The sensor pattern image forming method according to the invention has been described, by referring to FIG. 3, as being applied to an electrophotographic copying apparatus of the type in which scanning and exposing are performed by moving the scanning and exposing optical system. The concept on which the method is based also can have application in electrophotographic copying apparatus of the type in which scanning and exposing are performed by moving a document to be copied while keeping the optical system stationary. An embodiment of the sensor pattern image forming method in conformity with the invention will be described by referring to FIG. 4 which shows an electrophotographic copying apparatus of the latter type suitable for carrying the method into practice.

Figure 4:
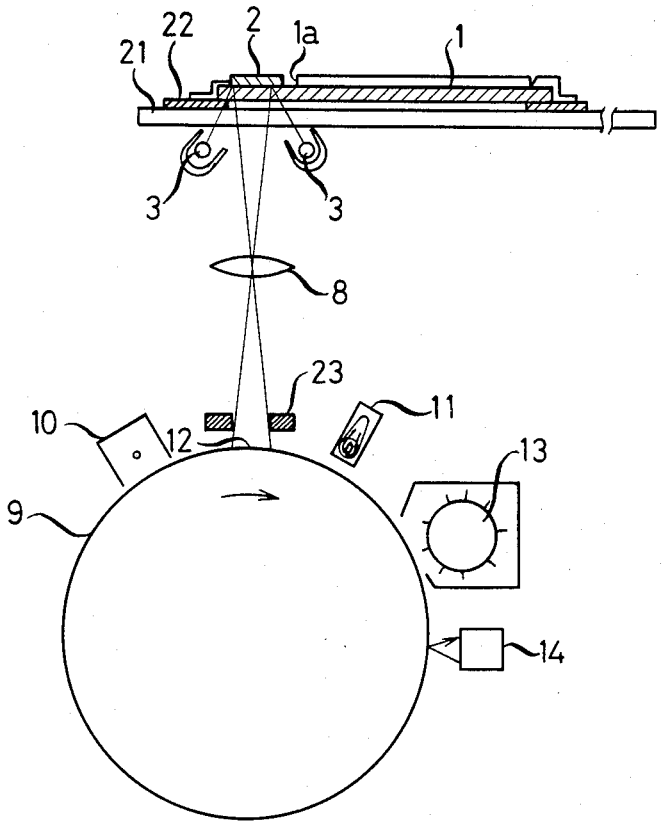
FIG. 4 is a sectional view of still another example of the electrophotographic copying apparatus suitable for carrying the pattern image forming method according to the invention into practice.

The contact glass member 1 for placing a document to be copied thereon includes the image forward end position 1*a* having disposed, as viewed in a vertical direction, in adjacent relation therewith the sensor pattern 2 of a reference density. The contact glass member 1 is supported on a scanner 22 capable of travelling within a predetermined scanning zone along rails 21 secured to a machine frame, so that the contact glass member 1 can move with the scanner 22 as a unit. When the contact glass member 1 is located in a home position as shown in FIG. 4, the exposing lamp 3 is located below the sensor pattern 2 in a position in which the pattern 2 can be illuminated by the lamp 3, and the image forming lens 8 is located in an optical path along which the light reflected by the pattern 2 illuminated by the exposing lamp 3 passes to the position 12 on the photosensitive drum 9 which is exposed to an optical image of the original. A slit 23 formed with an opening of a predetermined width is mounted in the exposing light path in the vicinity of the photosensitive drum 9. Arranged around the photosensitive drum 9 are the charger 10, exposing position 12, eraser 11, developing device 13 and P-sensor element 14 located in the indicated order in the direction of rotation of the drum 9 indicated by an arrow. Other parts of the copying apparatus are no different from those of known photoelectric copying apparatus.

The eraser 11 is controlled such that an electric charge is removed from the surface of the photosensitive drum 9 excepting a document image forming region and a sensor pattern image forming region. The eraser 11 can achieve the same effect when it is located immediately before the exposing position 12.

The sensor pattern 2 has a width (length in the scanning direction) which is such that the width of a bundle of light beams at the slit 23 is greater than the width of the opening of the slit 23.

When the photosensitive drum 9 is exposed to an optical image of the sensor pattern 2, the former is rotated at a predetermined velocity and the scanner 22 is kept stationary. While remaining stationary, the photosensitive drum 9 has projected thereon light beams commensurate with the density of the sensor pattern 2, to form thereon an optical image of a strip form having an axial length corresponding to the length of the sensor pattern 2 and a length extending circumferentially of the drum 9 determined by the width of the slit 23.

The length of the sensor pattern 2 sensed by the P-sensor element 14 is set at a minimum value to avoid influences that might otherwise be exerted on the cleaning device and other units. The desired length of the sensor pattern can be obtained by removing electrostatic latent image in a region other than the necessary region of the photosensitive drum 9 as a result of effecting on-off control of the eraser 11 in synchronism with the rotation of the photosensitive member 9. The velocity of rotation of the photosensitive drum 9 remains constant when copying is effected in an unequal image size copying mode, so that the size of the sensor pattern image also remains uncharged. It is necessary, however, that the width of the sensor pattern 2 be decided by taking into consideration the width of the opening of the slit 23 and variations in the position in which the scanner 22 can stop. The slit 23 may be located in the scanner section. In this case, the need to adjust the light volume in the variable image size copying mode can be eliminated.

The density of a document image is governed by the characteristics of various units of the copying apparatus, such as charger, exposing device, developing device, transfer-printing device, separation device, etc., and the precision with which these units are assembled. It is inevitable, however, that there are variations in the characteristics of these units and the precision with which they are assembled. Thus images of sensor patterns formed on the photosensitive members of electrophotographic copying apparatus of the same type would not necessarily have the same density even if the sensor patterns are of the same density. In copying apparatus wherein image density control is effected by the P-sensor process, it is necessary that adjustments of variations in the characteristics of various units, such as charger, exposing device, developing device, etc., and variations in their assembling be effected for each apparatus when the apparatus are produced and when their parts are replaced in such a manner that when the sensor pattern images on the photosensitive members formed by using sensor patterns of a predetermined reference density produce outputs of a predetermined value when sensed by the sensor.

It has been found that when the aforesaid adjustments are effected, excellent results can be achieved by rendering variable the developing bias of the copying apparatus, the density of the sensor pattern and the gain of the output of the sensor with respect to the density of the sensor pattern and varying one or more of these values to thereby cause a change to occur in the sensor pattern image density sensing output of the sensor and bring the output of the sensor in a standard condition into agreement with a predetermined image density control level.

Figure 5:
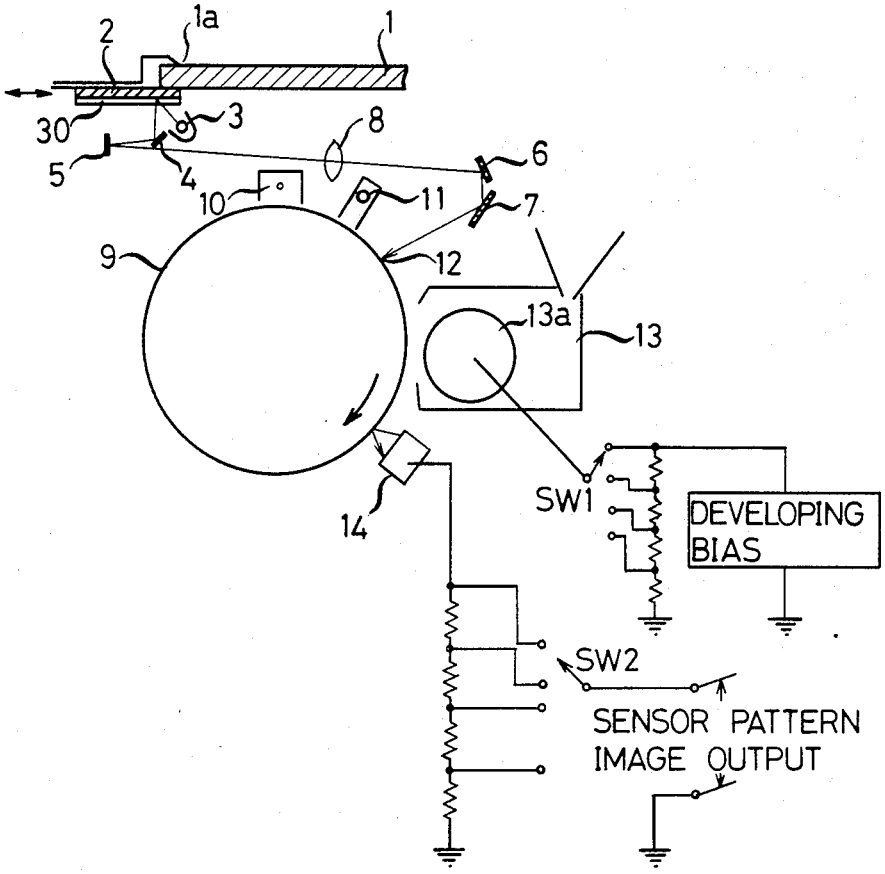
FIG. 5 is a schematic view of the adjusting means of the pattern image forming device shown in FIG. 1.

FIG. 5 shows an example of the copying apparatus shown in FIG. 1 which is provided with means for effecting the aforesaid adjustments according to the invention. As shown, the sensor pattern 2 is detachably attached to a support frame 30 and has a plurality of densities including a reference density that can be alternatively used.

The developing device 13 has a developing sleeve 13*a* on which a bias can be impressed by means of a switch SW1 by varying the value stepwise from 100 V to 250 V (standard, 200 V) with an increase of 50 V for each step.

The P-sensor element 14 is in the form of a photoelectric sensor of the reflection type composed of a light emitting member and a light receiving member, and is provided with a switch SW2 capable of splitting by resistance splitting the voltage impressed on the light emitting member into four levels of 0.6 V, 1.0 V, 1.5 V and 2.1 V (standard, 10 V). By varying the voltage impressed on the light emitting member, it is possible to vary the intensity of illumination of the light incident on the sensor pattern, so that the intensity of illumination of the reflected light to which the light receiving member is exposed can be varied even if the pattern is of the same density. As a result, the electric output of the sensor shows a change and the gain of the output of the sensor with respect to the density of the pattern also undergoes a change.

One example of operation of the copying apparatus of the aforesaid construction will be described. Conditions of operation were as follows. The density of the sensor pattern 2 was set at OD:0.8 in standard condition by considering that the sensor pattern 2 is located on the bottom surface of the contact glass member 1. The developing bias was set at 200 V (standard) by means of switch SW1, and the voltage impressed on the light emitting member of the P-sensor element 14 was set at 200 V (standard) by means of switch SW2. The results show that when the toner of the developing agent in the developing device 13 had a predetermined density, the output of the P-sensor element 14 agreed with a predetermined value set for the standard image density, if adjustments of variations in the characteristics of various units, such as charger, exposing device, developing device, etc., and variations in their assembling were satisfactorily effected when the apparatus had been produced. When the output of the P-sensor element 14 in standard condition does not agree with a predetermined value set for the density control level, it would be possible to readily bring the output of the sensor into agreement with the predetermined value by causing a change to occur in the output of the P-sensor as follows:

(a) The sensor pattern 2 is replaced by a sensor pattern of different density. This would cause a change to occur in the density of an image of the sensor pattern formed on the photosensitive member, thereby causing a change to occur in the output of the sensor.

(b) The bias impressed on the developing sleeve 13*a* is varied. This would cause a change to occur in developing conditions, thereby causing a change to occur in the density of an image of the sensor pattern formed on the photosensitive member and in the output of the P-sensor element.

(c) The voltage impressed on the light emitting member of the P-sensor element is varied. This would cause a change to occur in the volume of light emitted by the light emitting member of the sensor element and in the volume of light reflected by an image of the pattern. This in turn would cause a change to occur in the output gain of the sensor, thereby causing a change to occur in its output.

It has been found as the result of the operation described hereinabove that by varying one or more of the pattern density, developing bias and sensor output gain described hereinabove, it is possible to bring the output of the sensor in standard condition into agreement with a predetermined image density control level. It has also been found that by switching to any value as desired the image density control level with which a pattern image sensing output of the P-sensor element is compared, it is possible to control the density of an image to any level as desired.

Figure 6:
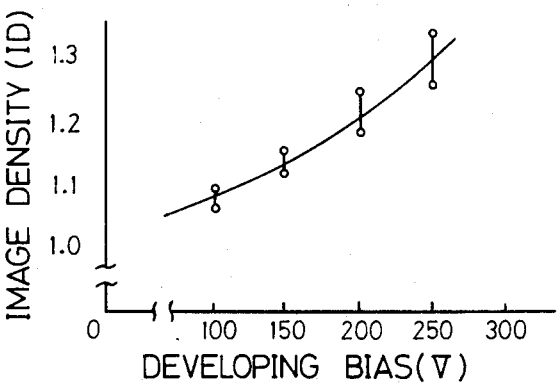
FIG. 6 is a graph showing one example of image density and variations thereof obtained when the value of the developing bias is varied in the pattern image forming device shown in FIG. 5.

When attempts were made to effect the aforesaid adjustments merely by varying the developing bias by actuating switch SW1, it has been found that, as shown in FIG. 6, the variation in the control level of the image density (ID) became greater as the developing bias had its value increased. When switch SW2 was actuated to vary only the output gain of the P-sensor element in an attempt to effect adjustments of the image density, it has been found that the variation in the image density control level was great in a low image density range.

From the results of the experiments described hereinabove, the following conclusions have been reached. When a copying apparatus is produced or repaired by a service engineer, it is preferred that adjustments of variations in the characteristics of various units concerned in the image density and variations in image density caused by an error committed in assembling the parts be effected by varying the density of the sensor pattern and, if necessary, the output gain of the P-sensor element with respect to the image density, so as to effect control with the standard image density (ID) being in the range between 1.2 and 1.25. When it is necessary to effect adjustments of image density to suit user's fancy or to cope with changes stemming from use of the apparatus over a prolonged period of time, it is advisable that means be provided for the user to effect adjustments to a certain degree by switching the developing bias to a different value.

It is known that a photosensitive member used with an electrophotographic copying apparatus undergoes a change in sensitivity with time if it is continuously used for forming electrostatic latent image thereon. Also, it is known that if it is left idled for a certain period of time before it is put to use again, its sensitivity shows a change in a direction opposite the direction of the first mentioned change. As a result, when the photosensitive member used has undergone a change in its sensitivity, the quality of an image formed on a copy sheet will be reduced or soiling of the background of the image will occur in the copy sheet because of a change caused to occur in the surface potential of the photosensitive member, even if the photosensitive member is exposed to optical images of different originals to form electrostatic latent images under the same exposing condition.

The aforesaid change in the sensitivity of the photosensitive member may vary depending on the type of the photosensitive member and the copying system used. Thus the surface potential of the photosensitive member may either gradually drop or rise after repeated use.

As described hereinabove, the photosensitive members might differ from one another in the characteristics when produced, and sensitivity might differ from one photosensitive member to another and from one copying apparatus to another. Thus even if copying were carried out under the same condition, no same result could be obtained at all times in reproducing images of a document or an original.

There is provided, besides the aforesaid method of varying the output gain of the developing bias or the P-sensor element by sensing the density of a toner image of the P-sensor pattern as described hereinabove, means for compensating for a change in the sensitivity of the photosensitive member whereby the photosensitive member is exposed to an optical image of a sensor pattern having an intermediate density under the same condition as it would be exposed to an optical image of an original to form an electrostatic latent image of the sensor pattern on the photosensitive member, and the surface potential of the sensor pattern image is sensed to control the voltage impressed on the exposing lamp, to thereby bring the surface potential of the electrostatic latent image of the sensor pattern to a predetermined value.

Figure 7:
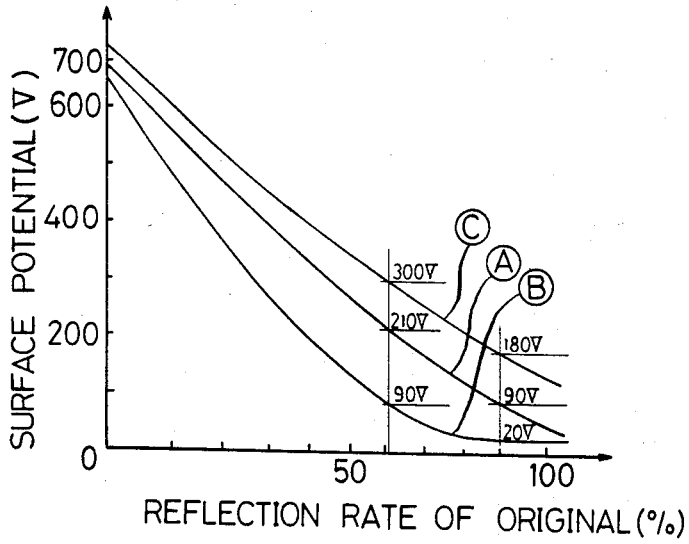
FIG. 7 is a diagram showing one example of variations in sensitivity obtained by varying the conditions of use of the photosensitive member.

The method referred to hereinabove will be described in detail. FIG. 7 is a diagram showing changes in the surface potential of a photosensitive member in relation to the reflection rate of original obtained by exposing the photosensitive member to optical images of the original under predetermined conditions when the photosensitive member was under the standard condition, when it was put to repeated use and when a first copy was produced after the apparatus was kept idle for a week, after the photosensitive member had been used on the copying apparatus.

In the diagram shown in FIG. 7, the abscissa represents the reflection rate of the original in %, the ordinate indicates the surface potential of the photosensitive member in V, and curves (A), (B) and (C) refer, respectively, to a surface potential of a photosensitive member obtained when the photosensitive member was under the standard condition, a surface potential obtained when the photosensitive member was repeatedly used, and a surface potential obtained when the photosensitive member was used to produce a first copy after being left idle for one week.

In the example shown in the figure, curve (B) shows a drop in potential over the entire range of values of the reflection rate of the original as compared with curve (A). Curve (B) shows that the greatest change in potential occurs when the reflection rate of the original is about 63%, with the surface potential dropping from 210 V to 90 V. It is also shown that when the reflection rate of the original is high in regions of low density and background area), the rate of decrease in surface potential is very high, as evinced by the drop from 90 V to 20 V when the reflection rate is 90%, for example.

When curve (C) is compared with curve (B), it is shown that the surface potential rises over the entire range of values of the reflection rate. More specifically, it will be seen that the higher the reflection rate, the greater is the change in surface potential until the reflection rate reaches 63%, as shown by an increase in surface potential from 210 V to 300 V when the reflection rate is 63% and an increase in surface potential from 90 V to 180 V when the reflection rate is 90%. However, it will be seen that the change in surface potential is constant when the reflection rate is over 63%.

Meanwhile the $\gamma$ characteristic of the image density with respect to the surface potential of the photosensitive member is constant. Thus if the photosensitive member shows a change in its sensitivity and the surface potential of the photosensitive member shows variations as shown in FIG. 7 when it is exposed to optical images of the original, the $\gamma$ characteristic of the image density (ID) with respect to the original density (OD) will naturally show a change.

It will be appreciated from the foregoing description that unless means is provided for correcting the surface potential of the photosensitive member in accordance with its condition or whether it has been repeatedly used, it is used for the first time after left idle for a prolonged pierod or it has just been replaced by a new one, no electrostatic latent image of high quality can be obtained.

Variations in the surface potential of a photosensitive member are caused by changes in the sensitivity thereof. Thus if the amount of exposure of the photosensitive member were varied in accordance with its sensitivity, it would be possible to obtain the same surface potential for the entire region of the original with respect to its density at all times.

Figure 8:
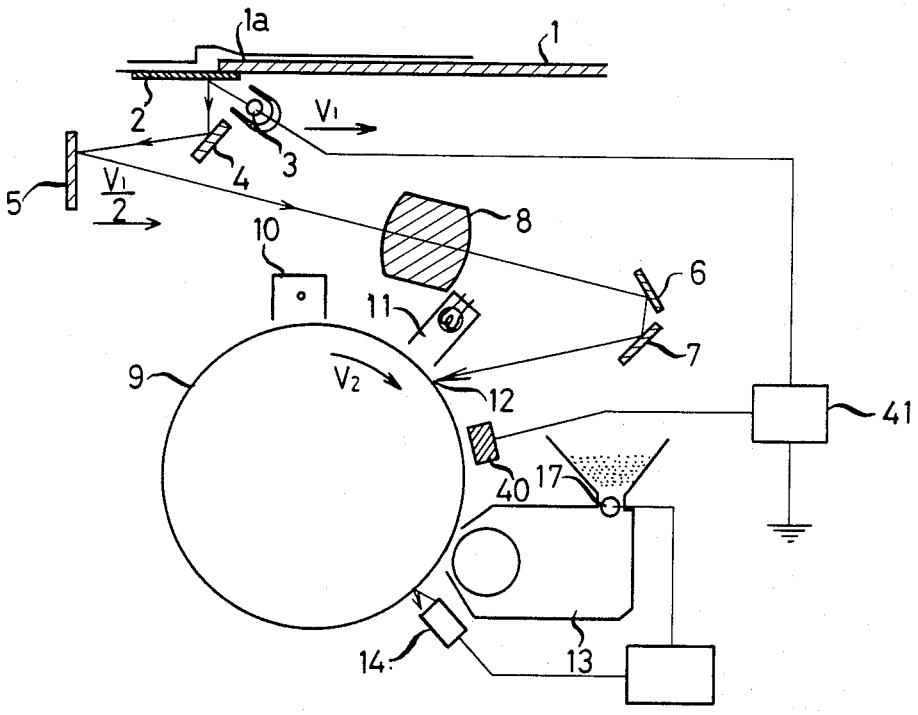
FIG. 8 is a schematic view showing means for compensating for variations in the sensitivity of the photosensitive member in the electrophotographic copying apparatus shown in FIG. 1.

Assume that the aforesaid correction of the surface potential of the photosensitive drum is effected in the copying apparatus shown in FIG. 1, for example. FIG. 8 shows a potentiometer 40 interposed between the exposing position 12 and the developing device 13 in the vicinity of the photosensitive drum 9 for measuring the potential of a latent image on the surface of the photosensitive drum 9 with respect to the pattern 2 of a reference density. The potentiometer 40 produces an output which is inputted to a controller 41 for the light source 3 where the measured potential is compared with a standard potential. A voltage impressed on the light source 3 is controlled in such a manner that the difference between the two potentials is rendered zero.

In this case, if a reflection rate of the original having a great change in surface potential and exerting large influences on the image (or about 63% in this example) is used as a reflection rate of the pattern 2 with respect to photosensitive members having the sensitivity variation curves shown in FIG. 7, the surface potential of the photosensitive member could be corrected with a high degree of precision.

What is claimed is:

1. A method of forming a visible image of a sensor pattern on a photosensitive member of an electrophotographic copying apparatus having a variable magnification or reduction rate suitable for use in conjunction with a method of controlling image density of copies produced by the copying apparatus, comprising the steps of:

placing the sensor pattern of a reference density substantially flush with a surface on which a document to be copies is placed;

exposing the surface of the photosensitive member that has been electrically charged by means of a charger to an optical image of said sensor pattern by exposing means to form a latent image of the sensor pattern in a region of the photosensitive member outside a document image forming region; and developing said latent image of the sensor pattern by developing means to obtain a visible image of the sensor pattern;

said visible image of the sensor pattern being used in said method of controlling image density in such a manner that the density of said visible image of the sensor pattern is sensed by means of a photoelectric element which produces an electric signal used for controlling the density of an image of a copy of the document;

wherein said method of forming a visible image of a sensor pattern is characterized by further comprising the step of:

erasing an electric charge from the surface of the photosensitive member excepting the document image forming region and the region of the latent image of the sensor pattern in an erasing step in which the electric charge is removed by irradiation of the region with light beams performed between the step of electrically charging the surface of the photosensitive member and the step of developing the latent image of the sensor pattern, to thereby restrict the region of said latent image of the sensor pattern to a region located within a region of the surface of the photosensitive member on which an image of the sensor pattern would be formed when copying is performed at a minimum rate of reduction of the electrophotographic copying apparatus.

2. A method as claimed in claim 1, wherein said erasing is performed before the surface of the photosensitive member is exposed to an optical image of the sensor pattern and after the surface of the photosensitive member is electrically charged.

3. A method as claimed in claim 1, wherein said erasing is performed after the surface of the photosensitive member is exposed to an optical image of the sensor pattern to form a latent image thereof and before said latent image is developed into a visible image.

4. A method of forming a visible image of a sensor pattern on a photosensitive member of an electrophotographic copying apparatus having a variable magnification or reduction rate suitable for use in conjunction with a method of controlling image density of copies produced by the copying apparatus, comprising the steps of:

placing the sensor pattern of a reference density substantially flush with a surface on which a document to be copied is placed;

exposing the surface of the photosensitive member that has been electrically charged by means of a charger to an optical image of said sensor pattern by exposing means to form a latent image of said sensor pattern in a region of the photosensitive member outside a document image forming region; and developing said latent image of the sensor pattern by developing means to obtain a visible image of the sensor pattern;

said visible image of the sensor pattern being used in said method of controlling image density in such a manner that the density of said visible image of the sensor pattern is sensed by means of a photoelectric element which produces an electric signal used for controlling the density of an image of a copy of the document;

wherein said method of forming a visible image of a sensor pattern is characterized by further comprising the step of:

erasing an electric charge from the surface of the photosensitive member excepting the document image forming region and the region of the latent image of the sensor pattern in an erasing step in which the electric charge is removed by irradiation of the region with light beams performed between the step of electrically charging the surface of the photosensitive member and the step of developing the latent image of the sensor pattern, to thereby restrict the region of said latent image of the sensor pattern to a region located within a region of the photosensitive member on which an image of the sensor pattern would be formed when copying is performed at a minimum rate of reduction of the electrophotographic copying apparatus; and wherein said exposing means remains stationary and the photosensitive member is moved at a predetermined velocity when the photosensitive member is exposed to an optical image of the sensor pattern.

* * * * *